United States Patent [19]

Teske

[11] Patent Number: 4,627,141

[45] Date of Patent: Dec. 9, 1986

[54] AUTOMOBILE HINGE PIN REMOVER

[76] Inventor: Eldor M. Teske, P.O. Box 107, North Prairie, Wis. 53153

[21] Appl. No.: 711,059

[22] Filed: Mar. 12, 1985

[51] Int. Cl.[4] ..... B25B 27/02
[52] U.S. Cl. ..... 29/275
[58] Field of Search ..... 29/254, 255, 275

[56] References Cited

U.S. PATENT DOCUMENTS

| | | | |
|---|---|---|---|
| 2,462,774 | 2/1949 | Pollock | 29/275 X |
| 3,099,876 | 8/1963 | Lawless | 29/275 X |
| 3,602,969 | 9/1971 | Provost | 29/275 |
| 3,757,409 | 9/1973 | Flanigan | 29/254 |
| 3,799,225 | 3/1974 | Chenel, Jr. | 81/44 |
| 4,183,133 | 1/1980 | Abbott | 29/275 |
| 4,329,766 | 5/1982 | Leonard et al. | 29/254 |
| 4,432,125 | 2/1984 | Monteleone et al. | 29/255 X |

FOREIGN PATENT DOCUMENTS

| | | | |
|---|---|---|---|
| 2075410 | 11/1981 | United Kingdom | 29/275 |

OTHER PUBLICATIONS

"A: Line by Ajax; Ajax Tool Works; 1980; p. 5-Hinge Pin Remover.

*Primary Examiner*—Frederick R. Schmidt
*Assistant Examiner*—Steven P. Schad
*Attorney, Agent, or Firm*—Michael, Best & Friedrich

[57] ABSTRACT

A hinge pin remover comprising an elongated shaft having a diameter and opposite first and second ends, the first end of the shaft being adapted to be driven by hammer means, the second end of the shaft forming a flat end having a thickness substantially less than the diameter of the shaft and having a depression therein, the second end including a second, elongated depression extending longitudinally from the first-mentioned depression, the shaft further including a hemispherical depression adjacent the second end, and a notch adjacent the second end, and the shaft being bent intermediate the first and second ends to form an obtuse angle and such that the first end of the shaft points upwardly when the shaft is positioned such that the hemispherical depression faces downwardly.

9 Claims, 9 Drawing Figures

12
14

10
14
12
16
20
26
28
18

12
16
20
12a 12
24
16
20
22

12
28
26
20
22

18
12

AUTOMOBILE HINGE PIN REMOVER

BACKGROUND OF THE INVENTION

The invention relates to apparatus for removing hinge pins, and, more particularly, to hinge pin removers for use on automobile hinge pins. Even more particularly, tne invention relates to hinge pin removers for use on hinge pins having either pointed ends or flat ends.

When repairing an automobile, it is frequently necessary to remove passenger door hinge pins in order to remove a passenger door. The removal of the hinge pins is often a difficult task due to conventional automobile constructions. More particularly, it is often impossible to gain access to the hinge pins with a hammer or with conventional air hammer apparatus in order to drive the hinge pins out of the hinges. This is because of both the construction of the hinges and the positioning of the hinges relative to the main frame of the automobile and to the door frame.

The known prior art includes a pneumatic tool adapted to remove and install automobile tube hinge pins or roll pins. This tool includes an end portion with a reduced diameter adapted to be slidably inserted into the inner bore of a tube hinge pin. Tnis tool will not remove solid hinge pins, which can have pointed ends or flat ends.

SUMMARY OF THE INVENTION

The invention provides a hinge pin remover for use on a solid automobile hinge pin having either a flat end or a pointed end, and having a head with an underside. The hinge pin remover of the preferred embodiment comprises an elongated shaft having opposite first and second ends. The first end of the shaft is adapted to be driven by hammer means, preferably by an air hammer. The second end of the shaft is tapered and includes opposite, generally flat surfaces converging to form a flat end having a thickness substantially less than the diameter of the shaft. This flat end is adapted to engage the underside of the head of tne hinge pin for driving the hinge pin out of the hinge. The flat end includes a circular depression adapted to engage the shaft portion of the hinge pin and to locate the flat end relative to the hinge pin.

One of the converging surfaces of the second end includes a second, elongated depression extending longitudinally from the circular depression in the flat end. This second depression is also adapted to engage the shaft portion of the hinge pin and to locate the hinge pin remover relative to the hinge pin as the hinge pin is driven out of a hinge. The other of tne converging surfaces includes a hemispherical or conical depression adapted to engage the pointed end of the hinge pin for driving the hinge pin out of a hinge. This surface further includes a circular notch adapted to engage the head of the hinge pin for driving the hinge pin into a hinge, or to engage the flat end of a hinge pin for driving the hinge pin out of a hinge.

The shaft is preferably bent intermediate the opposite ends to form an obtuse angle such that the first end of the shaft points upwardly when the shaft is positioned such that the surface including the hemispherical depression and the notch faces downwardly. Therefore, downward forces applied to the first end of the shaft by an air hammer are transmitted to the upper end of an upwardly inserted hinge pin engaged either by the hemispherical depression or by the notch. With the hinge pin remover in this position, downward forces applied to the first end of the shaft can also be transmitted to the underside of the head of the hinge pin in order to further drive the hinge pin out of the hinge. With the hinge pin remover positioned with the first end pointing downwardly, upward forces applied to the first end of the shaft are transmitted to the head of a hinge pin engaged by the notch in order to drive the hinge pin upwardly into the hinge. Obviously, all of the aforementioned operations can be reversed for a hinge pin inserted downwardly into a hinge.

A principal feature of the invention is the provision of a hinge pin remover including a hemispherical or conical depression adapted to engage the pointed end of a hinge pin for driving the hinge pin out of a hinge. The depression allows firm engagement of the pointed end of the hinge pin.

Another principal feature of the invention is the provision of a hinge pin remover including a flat end with a circular depression adapted to engage tne underside of the head of a hinge pin to drive the hinge pin out of a hinge. The flat end and the depression allow firm engagement of the underside of the head of the hinge pin. The circular depression keeps the hinge pin centered relative to the hinge pin remover.

Another principal feature of the invention is the provision of a hinge pin remover including a notch adapted to engage either the flat end of a hinge pin or the head of a hinge pin. The notch is preferably circular in order to provide firm engagement of the hinge pin.

Other features and advantages of the invention will become apparent to those skilled in the art upon review of the following detailed description, claims, and drawings.

Figures 1, 2, 3, 4, 5, 9:
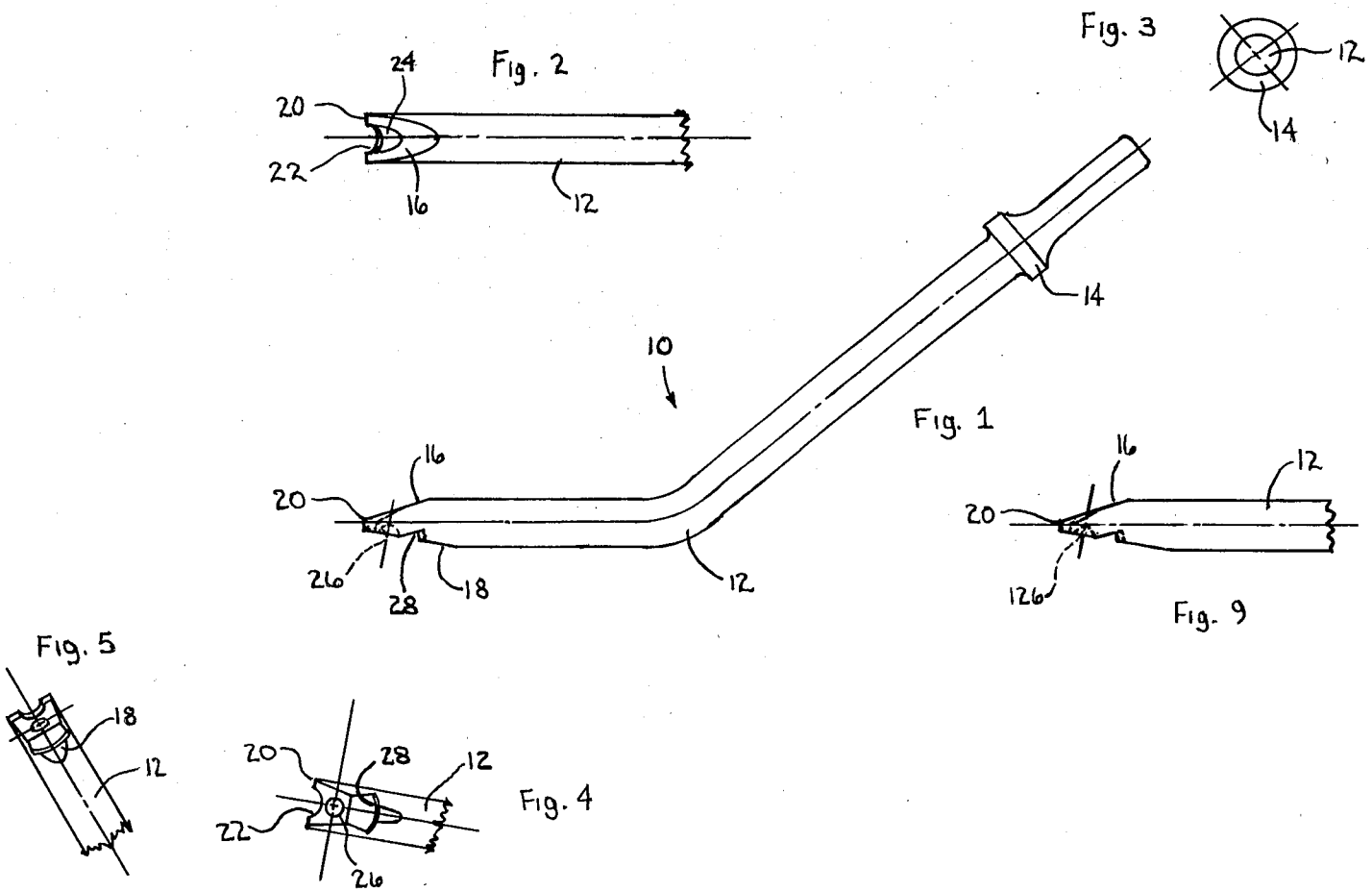
FIG. 1 is a side elevational view of a hinge pin remover embodying the invention.
FIG. 2 is a partial top view of the hinge pin remover shown in FIG. 1.
FIG. 3 is an end view of the hinge pin remover shown in FIG. 1.
FIG. 4 is a partial bottom view of the left end of the hinge pin remover shown in FIG. 1.
FIG. 5 is a perspective view of the left end of the hinge pin remover shown in FIG. 1.
FIG. 9 is a side view of the left end of a hinge pin remover which is an alternative embodiment of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A hinge pin remover 10 embodying the invention is illustrated in the drawings. As best shown in FIG. 1, the hinge pin remover 10 comprises a member, preferably an elongated shaft 12, having opposite first and second or right and left ends as seen in FIG. 1. The right end of the shaft 12 is adapted to be driven oy an air hammer. Accordingly, the shaft 12 includes a shoulder 14 adjacent the right end as is commonly found on pneumatic tools.

As also best shown in FIG. 1, the shaft 12 is bent intermediate its opposite ends to form an obtuse angle. Preferably, this angle is approximately 140°. The reason for this angle is explained hereinafter.

Figure 7:
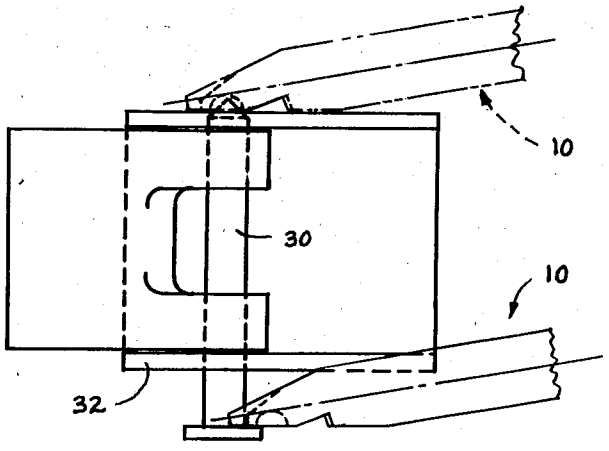
FIG. 7 is a view similar to FIG. 6 showing the hinge pin remover engaging the pointed end of the hinge pin (dotted lines), and showing the hinge pin remover engaging the underside of the head of the hinge pin (solid lines).

The hinge pin remover 10 includes means adjacent the second or left end of the shaft 12 for engaging the underside of the head of a hinge pin for driving the hinge pin out of a hinge. In the preferred embodiment, the left end of the shaft 12 is tapered and includes opposite, generally flat first and second or upper and lower surfaces 16 and 18 as seen in FIG. 1. These surfaces 16 and 18 converge to form a flat end 20 having a thickness substantially less than the diameter of the shaft 12. The flat end 20 is adapted to engage the underside of the head of a hinge pin for driving the hinge pin out of a hinge. This is illustrated in FIG. 7. The flat end 20 preferably includes a circular depression 22 adapted to engage the shaft portion of the hinge pin and to locate the flat end 20 relative to the hinge pin. In other words, the circular depression 22 engages the shaft portion of the hinge pin and prevents the end of the hinge pin remover 10 from sliding to either side relative to the hinge pin.

The upper surface 16 includes a second, elongated, circular depression 24 extending longitudinally of the shaft 12 from the circular depression 22. This second depression 24 is also adapted to engage the shaft portion of the hinge pin and to locate the hinge pin remover 10 relative to the hinge pin as the hinge pin remover 10 is rotated relative to the hinge pin, as explained hereinafter.

Figure 6:
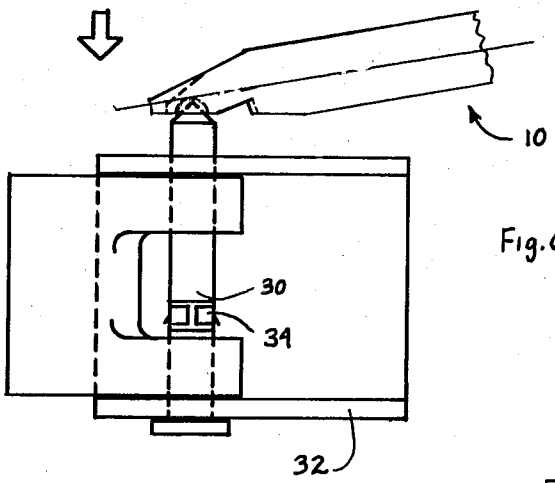
FIG. 6 is a side elevational view showing the hinge pin remover engaging the pointed end of a hinge pin.

The hinge pin remover 10 also includes means adjacent the second or left end of the shaft 12 for engaging the pointed end of a hinge pin for driving the hinge pin out of a hinge. In the preferred embodiment, the lower surface 18 includes a hemispherical depression 26 adapted to engage the pointed end of a hinge pin for driving the hinge pin out of a hinge. This is illustrated in FIGS. 6 and 7. The depression 26 allows firm engagement by the hinge pin remover 10 of the pointed end of the hinge pin. In an alternative embodiment of the invention, as illustrated in FIG. 9, the hinge pin remover can have a conical depression 126 instead of the hemispherical depression 26.

Figure 8:
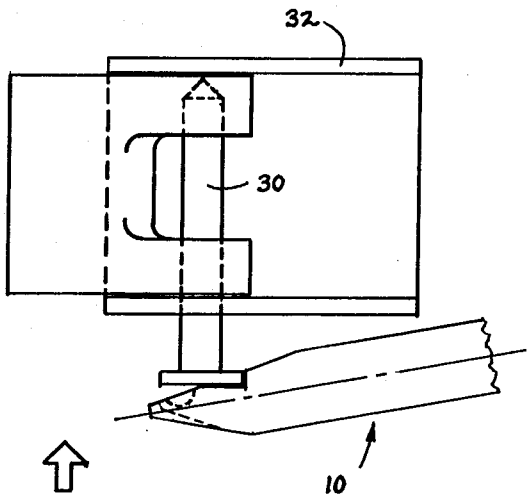
FIG. 8 is a view similar to FIGS. 6 and 7 showing the hinge pin remover engaging the head of the hinge pin and driving the hinge pin upwardly into the hinge.

The hinge pin remover 10 further includes means adjacent the second or left end of the shaft 12 either for engaging the head of a hinge pin for driving the hinge pin into a hinge, or for engaging the flat end of a flat ended hinge pin for driving the hinge pin out of a hinge. In the preferred embodiment, the lower surface 18 further includes a circular notch 28 adapted to engage either the head of the hinge pin for driving the hinge pin into a hinge, as shown in FIG. 8, or to engage the flat end of a flat ended hinge pin for driving the hinge pin out of a hinge (not shown). The circular shape of the notch 28 provides firm engagement of the hinge pin.

As best shown in FIG. 1, the shaft 12 is preferably bent such that the first or right end of the shaft 12 points generally upwardly when the shaft is positioned such that the second or lower surface 18 faces downwardly. This is so that when the hinge pin remover 10 is positioned as shown in FIGS. 1, 6, and 7, downward forces applied to the right end of the shaft 12 by an air hammer or other hammer means are transmitted to an upwardly inserted hinge pin for driving tne hinge pin downwardly out of a hinge. With the hinge pin remover 10 in the position shown in FIG. 1, the hinge pin remover 10 can also be used to drive a downwardly inserted hinge pin downwardly into a hinge. By turning the hinge pin remover 10 upside down relative to the position shown in FIG. 1, the hinge pin remover 10 can be used to drive a downwardly inserted hinge pin upwardly out of a hinge. Also, in this upside down position, the hinge pin remover 10 can be used to drive an upwardly inserted hinge pin upwardly into its hinge as shown in FIG. 8.

Operation of the hinge pin remover 10 will be described in connection with a hinge pin 30 inserted upwardly into a hinge 32, as illustrated in FIGS. 6 through 8, out it should be understood that the hinge pin remover 10 works equally well on a hinge pin inserted downwardly into a hinge. (A conventional automobile door is connected to the main frame of the automobile by two hinges, with one of the hinges having a hinge pin driven upwardly into the hinge, and with the other hinge having a hinge pin driven downwardly into the hinge.) The hinge pin remover operates as follows.

To initiate downward movement of the hinge pin 30 out of the hinge 32, the hinge pin remover 10 is positioned as shown in FIGS. 1 and 6 with the depression 26 engaging the pointed end of the hinge pin 30. If the hinge pin remover 10 is being used on a flat ended hinge pin, the hinge pin remover 10 is positioned with the notch 28 engaging the flat end of the hinge pin. Actuation of the air hammer (not shown) causes the hinge pin 30 to be driven from the position shown in FIG. 6 to the position shown in dotted lines in FIG. 7. If the hinge pin 30 includes a clip 34 preventing movement of the hinge pin 30 downwardly out of the hinge 32, as shown in FIG. 6, the projections on the clip 34 can be clamped tightly against the hinge pin 30 with a pair of Vise-Grips or a similar clamping device in order to allow passage of the clip 34 and the hinge pin 30 out of the hinge 32.

When the hinge pin 30 is in the position shown in dotted lines in FIG. 7, the end of the hinge pin remover 10 is then positioned against the underside of the head of the hinge pin 30 and against the shaft portion of the hinge pin 30 as shown in solid lines in FIG. 7. At this point, the underside of the head of tne hinge pin 30 is engaged by the lower surface 18 of the hinge pin remover 10. Actuation of the air hammer now drives the hinge pin 30 completely out of the hinge 32. As the hinge pin 30 moves downwardly out of the hinge 32, the hinge pin remover 10 is rotated counter clockwise (as viewed in FIG. 7) relative to the hinge pin 30 in order to increase the downward force transmitted by the hinge pin remover 10 to the hinge pin 30. As the hinge pin remover 10 is rotated, the flat end 20 of the hinge pin remover 10 moves into engagement with the underside of the head of the hinge pin 30, and the second depression 24 engages the shaft portion of the hinge pin 30 and locates the hinge pin remover 10 relative to the hinge pin 30.

To reinsert the hinge pin 30, the hinge pin remover 10 is positioned generally upside down relative to the position shown in FIG. 1, with the notch 28 engaging the head of the hinge pin 30. Actuation of the air hammer now drives the hinge pin 30 completely into the hinge 32.

As mentioned previously, it is frequently impossible with conventional automobile hinge assemblies to gain access directly above or below the hinge pin. The angle in the shaft 12 of the hinge pin remover 10 allows the second end of the hinge pin remover 10 to be inserted almost horizontally to engage the hinge pin 30, as shown in FIGS. 6 through 8. At the same time, the first end of the shaft 12 is laterally spaced from the second end, so that the hinge pin remover 10 and air hammer can clear the hinge, the door frame, and the main frame of the automobile.

Various other features and advantages of the invention are set forth in the following claims.

I claim:

1. A hinge pin remover for use on a hinge pin having a pointed end, a shaft portion and a head with an underside, said remover comprising a member which is a shaft having opposite first and second ends and a diameter, said first end being adapted to be driven by hammer means, and second end being tapered and including opposite, converging, generally flat first and second surfaces, said first and second surfaces converging to form a flat end having a thickness substantially less than the diameter of said shaft, said flat end being adapted to engage the underside of the head of the hinge pin for driving the hinge pin out of a hinge, and said flat end including a first depression adapted to engage the shaft portion of the hinge pin and to locate said flat end relative to the hinge pin, and one of said surfaces including a second, elongated depression extending longitudinally of said shaft from said first depression, said member including means adjacent said second end for engaging the pointed end of the hinge pin for driving the hinge pin out of the hinge.

2. A hinge pin remover as set forth in claim 1 wherein said member further includes means adajcent said second end for engaging the head of the hinge pin for driving the hinge pin into a hinge.

3. A hinge pin remover as set forth in claim 1 wherein said means for engaging the pointed end of the hinge pin includes a third depression in said member.

4. A hinge pin remover as set forth in claim 3 wherein said third depression is hemispherical.

5. A hinge pin remover as set forth in claim 3 wherein said third depression is conical.

6. A hinge pin remover as set forth in claim 1 wherein said means for engaging the pointed end of the hinge pin includes a third depression in one of said surfaces.

7. A hinge pin remover as set forth in claim 6 wherein said member is an elongated shaft bent intermediate said ends such that said first end of said shaft points upwardly when said shaft is positioned such that said one of said surfaces faces downwardly.

8. A hinge pin remover as set forth in claim 1 for use on a hinge pin also having a head, wherein one of said surfaces includes a notch adapted to engage the head of the hinge pin for driving the hinge pin into a hinge.

9. A hinge pin remover comprising an elongated shaft having a diameter and opposite first and second ends, said first end of said shaft being adapted to be driven by hammer means, said second end of said shaft forming a flat end having a thickness substantially less than the diameter of said shaft and having a depression therein, said second end including a second, elongated depression extending longitudinally of said shaft from said first-mentioned depression, said shaft further including a hemispherical depression opposite said second depression and adjacent said second end, and a notch adjacent said second end opposite said second depression, and said shaft being bent intermediate said first and second ends to form an obtuse angle and such that said first end of said shaft points upwardly when said shaft is positioned such that said hemispherical depression and said notch face downwardly.

* * * * *